US005365240A

United States Patent [19]

Harmuth

[11] Patent Number: 5,365,240

[45] Date of Patent: Nov. 15, 1994

[54] EFFICIENT DRIVING CIRCUIT FOR LARGE-CURRENT RADIATOR

[75] Inventor: Henning F. Harmuth, Potomac, Md.

[73] Assignee: Geophysical Survey Systems, Inc., North Salem, N.H.

[21] Appl. No.: 971,195

[22] Filed: Nov. 4, 1992

[51] Int. Cl.[5] ..... H01Q 1/26

[52] U.S. Cl. ..... 343/701; 327/108; 327/484

[58] Field of Search ..... 343/701, 749, 850, 858, 343/876; 307/246; H01Q 1/26

[56] References Cited

U.S. PATENT DOCUMENTS 4,506,267 3/1985 Harmuth ..... 343/744

4,862,013 8/1989 Konopka ..... 307/246

*Primary Examiner*—Donald Hajec

*Assistant Examiner*—Hoanganh Le

*Attorney, Agent, or Firm*—Wolf, Greenfield & Sacks

[57] ABSTRACT

An improved driving circuit for a large-current radiator avoids the need to dissipate large powers in the driving circuit by drawing a certain energy value from a power supply to a storage capacitor and then feeding this energy to the radiating antenna. A constant current source provides, when a switching circuit coupled to the radiator is opened, a current to counter the tendency of the radiator otherwise to maintain continuity of current through the switching circuit, keeping to a minimum the voltage across the switching circuit so that essentially no energy will need to be dissipated in the driving circuit. By choosing the stored energy value carefully one can make it just large enough to cover the radiated energy but leave essentially no energy to be dissipated in the radiator driving circuit.

10 Claims, 10 Drawing Sheets a,d
b,c
a,d
$i_1(t)$
-I $i_2(t)$

I
$i_3(t)$ $i_4(t)$

I
i(t)
-I $V_{1/2}$
$V_1$
$v_1(t)$ $V_1$
$V_{1/2}$
$v_2(t)$ $V_2$
$V_{1/2}$
$v_3(t)$ $V_1$
$V_{1/2}$
$v_4(t)$ $V_1$
v(t)
$-V_1$ t
$t_1$
$t_2$
$t_3$
$t_4$
$t_5$
$t_6$

EFFICIENT DRIVING CIRCUIT FOR LARGE-CURRENT RADIATOR

BACKGROUND OF THE INVENTION

This invention provides an improvement to the large-current radiator described in U.S. Pat. No. 4,506,267. The original radiator of that patent feeds energy to an antenna that radiates it. At certain times there is little or no radiation and the energy is dissipated in the active elements of the driving circuit; the active elements are typically transistors, light activated semiconductor switches (LASS), or electron tubes known as pulsatrons. The active elements must be designed to tolerate the largest dissipation of the energy. The need to dissipate rather than to radiate energy is a drawback for a number of reasons. A driving circuit is disclosed which drastically reduces the energy that needs to be dissipated.

SUMMARY OF THE INVENTION

In accordance with the present invention, a suitable radiator driving circuit comprises at least one capacitor into which a certain electric energy is charged from a voltage source via a carefully timed switch and an inductor. The amount of this energy is limited to be just large enough to be radiated in the radiator when this energy is fed to the radiator. A constant current source provides, when a switching circuit coupled to the radiator is opened, a current to counter the tendency of the radiator otherwise to maintain continuity of current through the switching circuit, keeping to a minimum the voltage across the switching circuit so that essentially no energy will need to be dissipated in the driving circuit. The invention will be more fully understood from the detailed description presented below, which should be read in conjunction with the accompanying drawing.

DETAILED DESCRIPTION

Figure 1:
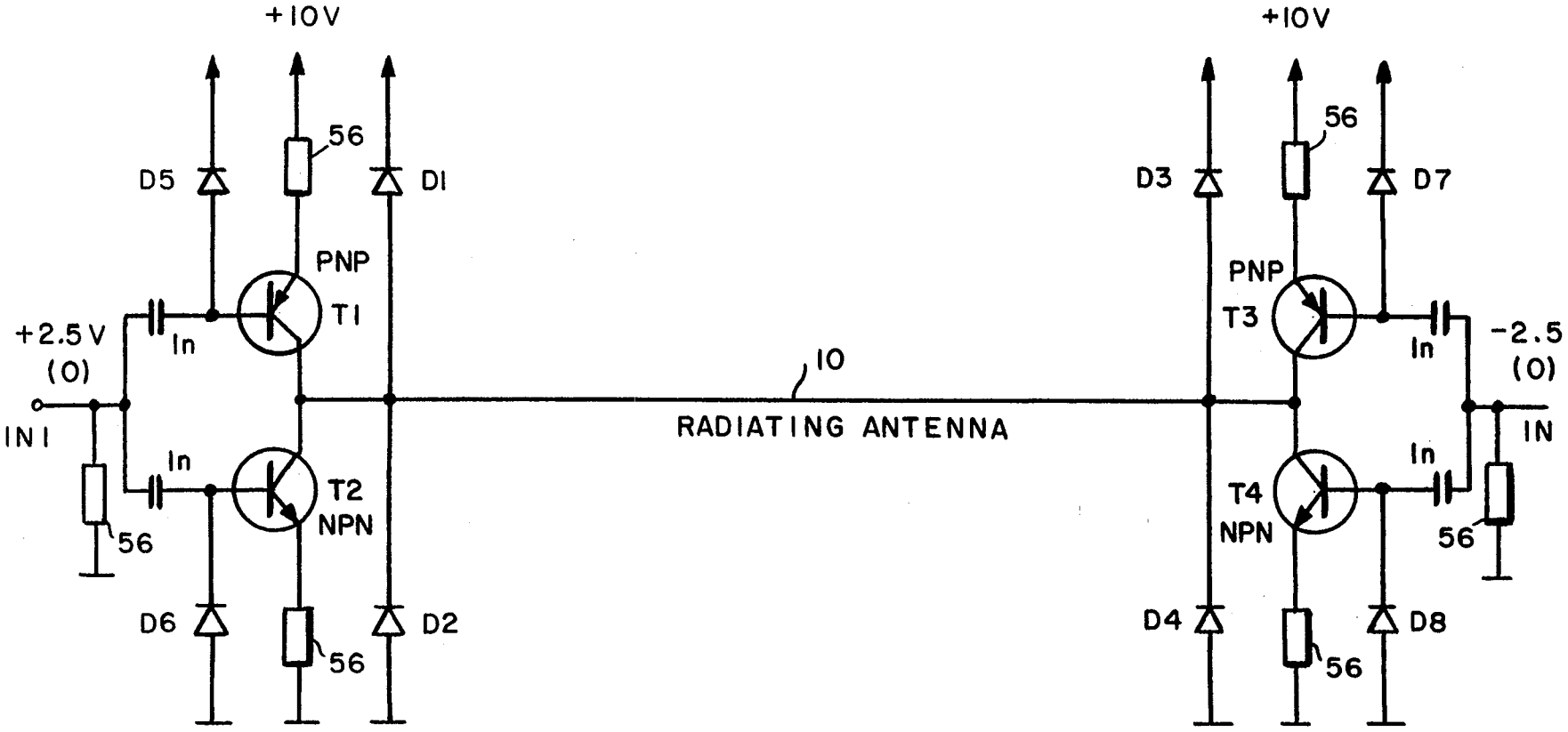
FIG. 1 PRIOR ART
FIG. 1 is a schematic circuit diagram for a typical prior art driving circuit for the large-current radiator represented by the "radiating antenna" 10.
Figure 2A:
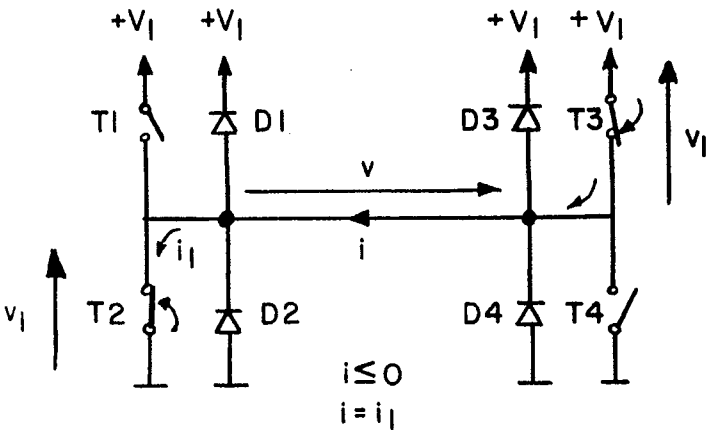
FIGS. 2A–2D are simplified schematic circuit diagrams for use in explaining the operation of the circuit of FIG. 1.

Referring now to FIG. 1, let a positive pulse with voltage +2.5 V be fed to the terminal IN1 in FIG. 1 and a negative pulse with a voltage −2.5 V to terminal IN2. The transistors T2 and T3 will become conducting and a current will flow from the terminal +10 V via T3, the radiating antenna, and T2 to ground. This state is shown in FIG. 2A with switches replacing the four transistors; certain circuit components of secondary importance are left out. The arrows at the switches T2 and T3 indicate that these switches are being closed. The current $i=i(t)$ is shown as well as the voltages $v_1$, v across the switches and the radiating antenna. Note that there is always a voltage across a switch even though this voltage is usually ignored for mechanical switches.

Figure 2B:
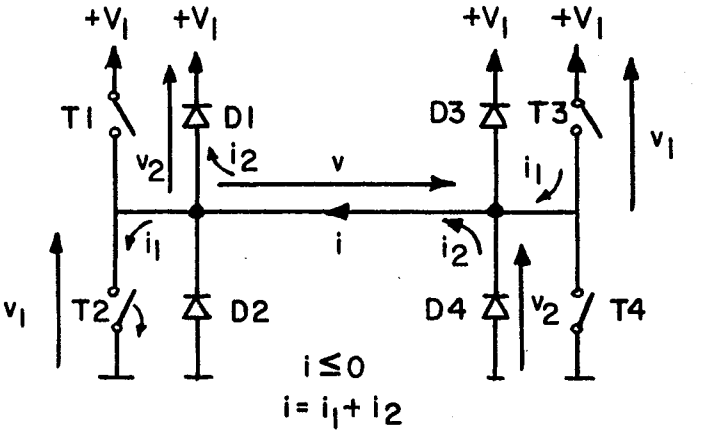

Let the switches T2 and T3 be opened as shown in FIG. 2B. Since the radiating antenna not only radiates but also produces a near field or inductive field that acts like the field of an inductor, the current i does not stop instantly. The radiating antenna becomes a power source that attempts to maintain the current i. If the switches T2 and T3 opened instantly, the new power source would create a sufficiently high voltage to bridge the switches with arc discharges. The diodes D1 and D4 prevent such high voltages by providing an alternate current path when radiating antenna is the power source. The relation $i=i_1+i_2$ shows that the current through the diodes increases as the current through the switches decreases. The current $i_2$ shows that the current through the diodes increases as the current through the switches decreases. The current $i_2$ can be used to feed part of the energy stored in the near field of the radiating antenna back to the power supply. Once all stored energy is either returned to the power supply, dissipated in ohmic resistances of the circuit, or radiated as a usually unwanted radiation, the current i becomes zero.

Figure 2C:
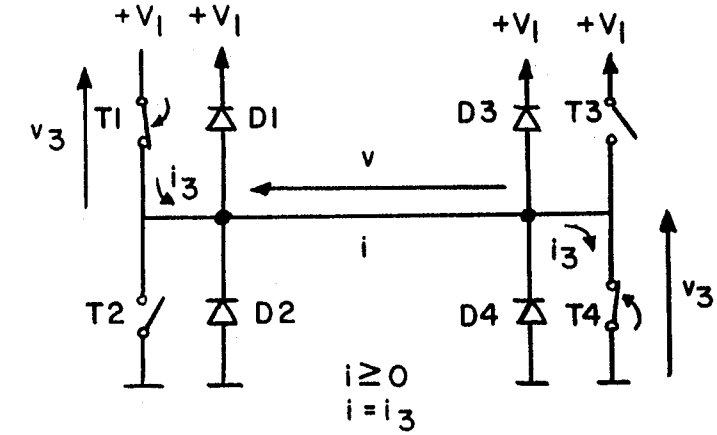
Figure 2D:
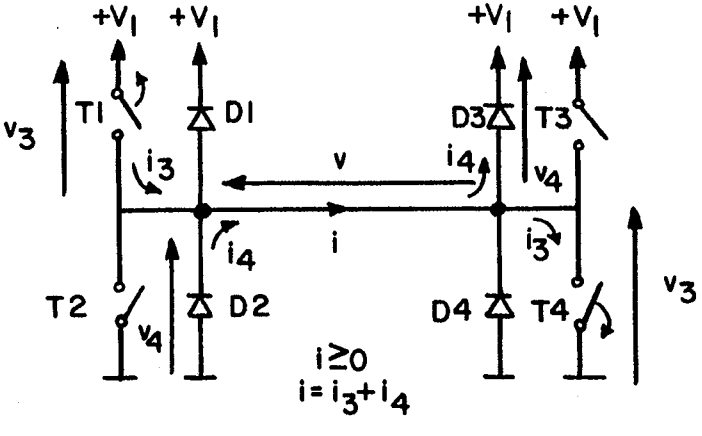

FIG. 2C shows the switches T1 and T4 closed. The current i in the radiating antenna now flows in the opposite direction from FIG. 2A. If T1 and T2 are opened as shown in FIG. 2D one gets a current through the diodes D2 and D3 for the discharge of the energy in the near field of the radiating antenna.

Figures 3A, 3B, 3C, 3D, 3E, 3F, 3G, 3H, 3I, 3J:
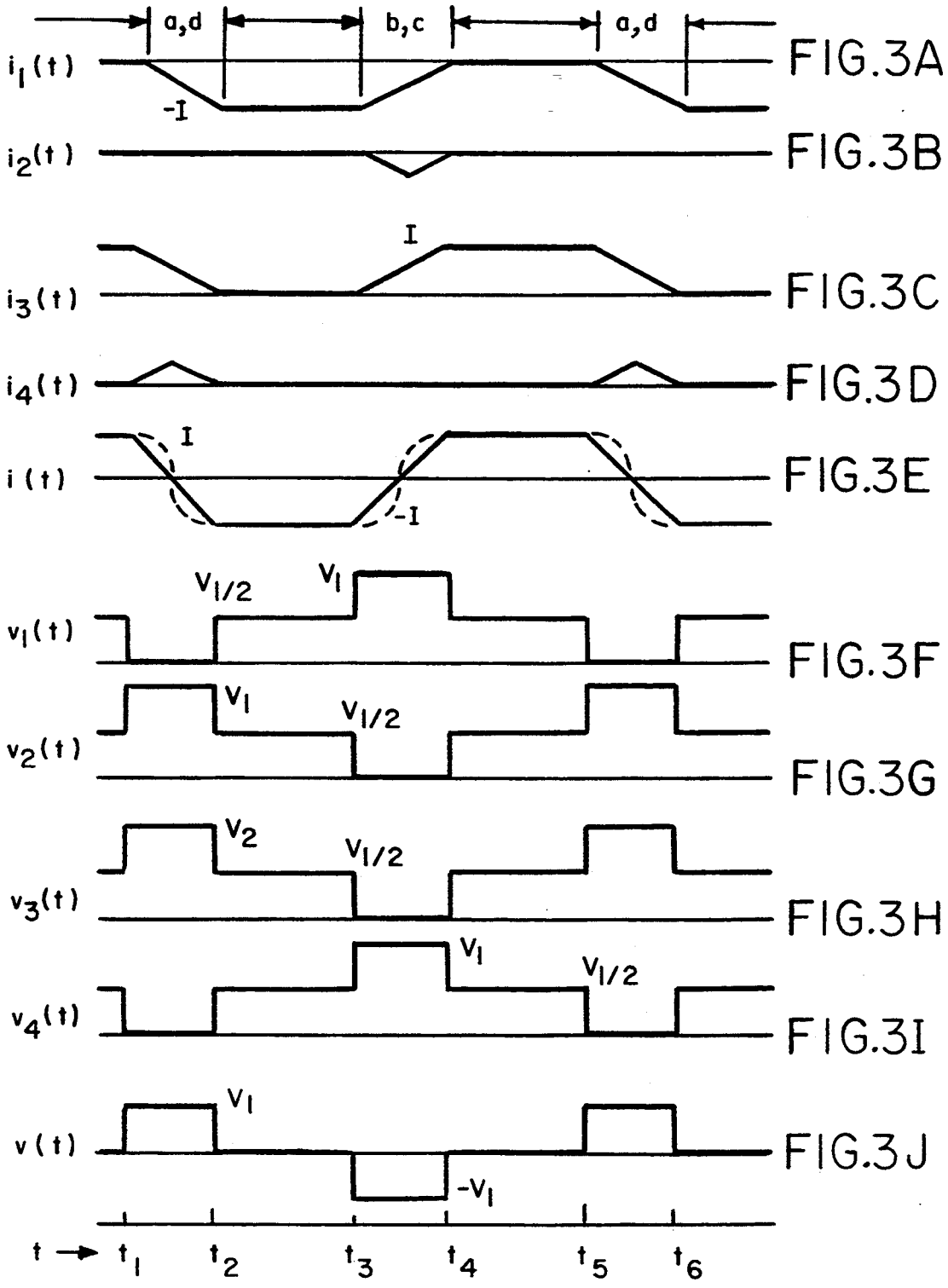
FIGS. 3A–3J are amplitude-versus-time plots of currents and voltages for the circuit of FIG. 2.

FIG. 3 shows a time diagram for FIG. 2. The current $i_1$ drops from zero to −I during the time $t_1 \leqq t \leqq t_2$, then it remains constant until $t_3$, and increases to zero at $t_4$. The current $i_2$ through the diodes D1 and D4 flows during the time $t_3 \leqq t \leqq t_4$. The current $i_3$ rises in the interval $t_3 \leqq t \leqq t_4$ from zero to I, stays constant till $t_5$ and drops to zero at $t_6$. A current $i_4$ flows whenever $i_3$ drops to zero.

The sum of the currents $i_1$ and $i_3$ is shown as i plotted with a solid line in FIG. 3. The sum $i=i_1+i_2+i_3+i_4$ produces the transition between +I and −I or −I and +I shown by a dashed line for i(t). To simplify drafting we will generally ignore this correction of i(t) by $i_2(t)$ and $i_4(t)$.

The voltages $v_1(t)$ to v(t) in FIG. 3 are shown with considerable idealization. The voltage $v_1$ is zero if switch T2 is closed and the current $i_1(t)$ varies from 0 to −I in the interval $t_1 \leqq t \leqq t_2$. When the current $i_1(t)$ is constant in the interval $t_2 \leqq t \leqq t_3$ the voltage $v_1(t)$ equals $V_1/2$. When T2 opens at the time $t_3$, $v_1(t)$ jumps to $V_1$ (minus about 0.5 V across the diode D1). One may readily derive the other voltages $v_2(t)$ to $v_4(t)$. Of interest is the voltage v(t) across the radiating antenna. It is zero when i(t) is constant, $+V_1$ when i(t) changes from +I to −I, and $-V_1$ when i(t) changes from −I to +I.

When v(t) is $+V_1$ or $-V_1$, the power $IV_1$ is radiated by the antenna. However, when v(t) is zero, the power is dissipated in the circuit. During the time $t_2 \leqq t \leqq t_3$ the current i(t) has the value −I and the voltages $v_1(t)$, $v_2(t)$ equal $V_1/2$. The power $V_1I$ is dissipated essentially in the two switches T2 and T3. Similarly, the power $V_1I$ is dissipated in the two switches T1 and T4 during the time $t_4 \leqq t \leqq t_5$. Hence, the radiated power $IV_1$ can only be twice as large as the power $IV_1/2$ that can be dissipated in one switch. A reduction of the power dissipated in the switches will permit an increase of the radiated power without overloading the switches. This is of minor interest if one radiates power in the order of a milliwatt, but it becomes of great interest when one wants to radiate powers in the order of a kilowatt and more.

Figure 4:
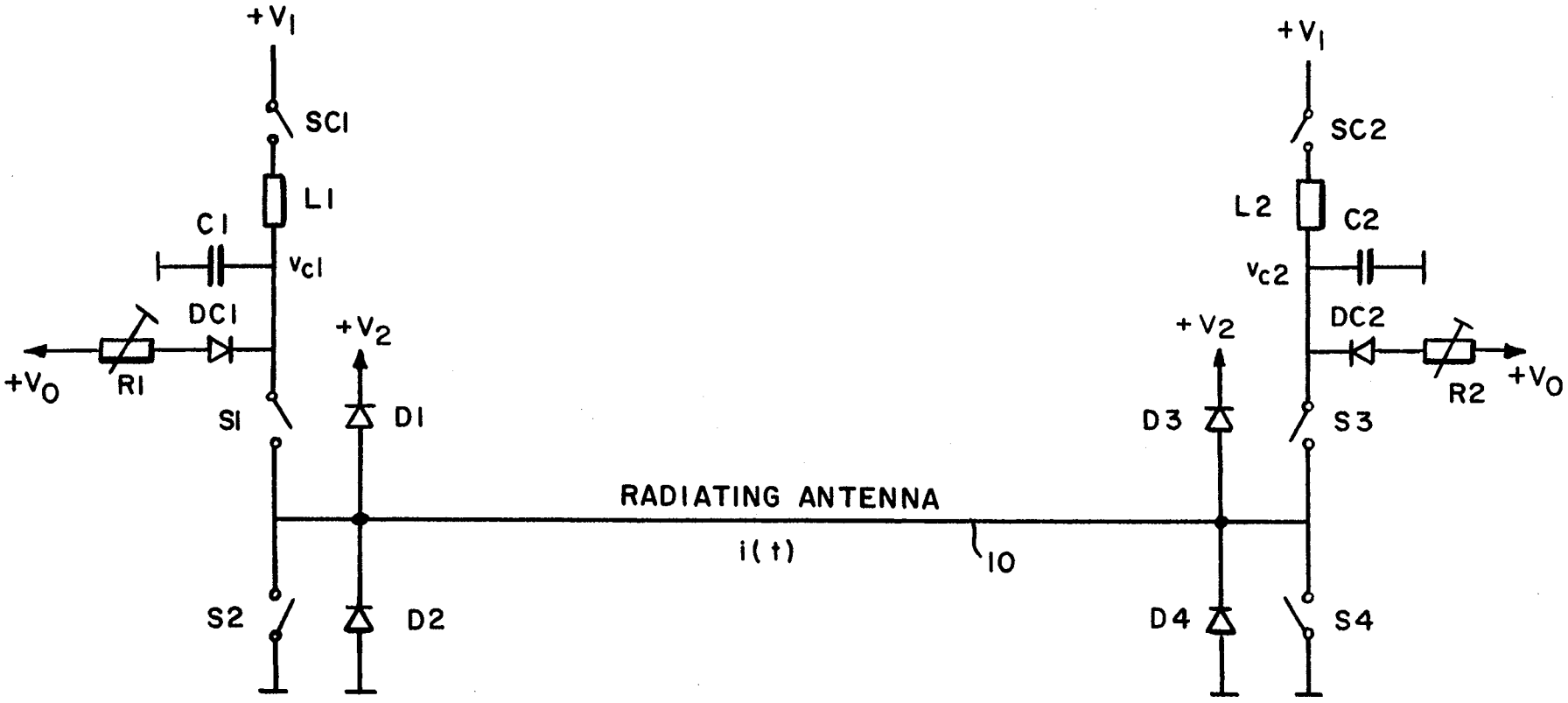
FIG. 4 is a schematic circuit diagram for an improved version of the circuit of FIG. 1; a switch SC1, and inductor L1, a capacitor C1, and a clamping circuit represented by a diode DC1, resistor R1, and voltage $V_O$ have been added.

To achieve this goal we may modify the circuit of FIG. 1 as shown in FIG. 4. The transistors T1 to T4 are now replaced by switches that may represent transistors or a variety of other switching devices. If MOS transistors are used in FIG. 1, one can use a voltage of about 10 V. With a current of 10 A one can thus switch a power of 100 W. If the switching is done in 1 ns, one may produce radiated pulses with an energy of about $100 \times 10^{-9}J = 10^{-7}J$. This is sufficient for ground-probing radar with short range due to the high signal or pulse repetition rate permitted by a short range. If the switches are implemented by light activated semiconductor switches (LASS) one currently can switch powers of about 100 MW and produce pulses with an energy of 0.1J to 0.5J. A signal consisting of a sequence of 100 pulses will have an energy of 10J to 50J, which is typical for line-of-sight radars. The most powerful switches at this time are vacuum tubes known as pulsatrons. They can switch voltages of 250 kV and currents of 50 kA, or a power of 12.5 GW. The energy of one pulse is in the order of 10J and the energy of a signal consisting of 100 pulses is in the order of 1 kJ. The circuit of FIG. 4 and its variations to be described later apply to all three implementations of switches. The importance of not dissipating power in the circuit increases with the energy of the radiated pulses.

Figure 5:
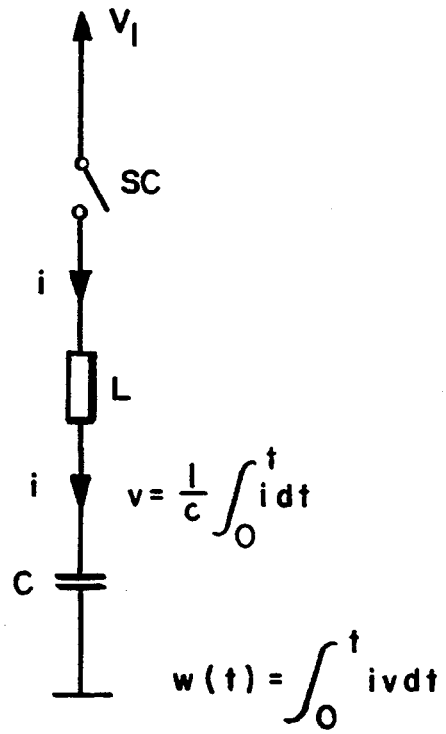
FIG. 5 is a simplified illustration of a part of the circuit of FIG. 4 with current i, voltage v, and energy w stored in the capacitor.

Consider first the part of the circuit of FIG. 4 consisting of the switch SC1, inductor L1, and capacitor C1, or of SC2, L2 and C2. This circuit with current i(t), voltage across the capacitor v(t) and energy in the capacitor w(t) is shown in FIG. 5. A calculation yields the following values:

$$i(t) = V_1 \frac{L}{C} \sin\left(\frac{t}{\sqrt{LC}}\right) \quad (1)$$

-continued $$v(t) = V_1\left(1 - \cos\frac{t}{\sqrt{LC}}\right) \quad (2)$$

$$w(t) = \frac{1}{2} CV_1^2\left(1 - \cos\frac{t}{\sqrt{LC}}\right)^2 \quad (3)$$

Figure 6A:
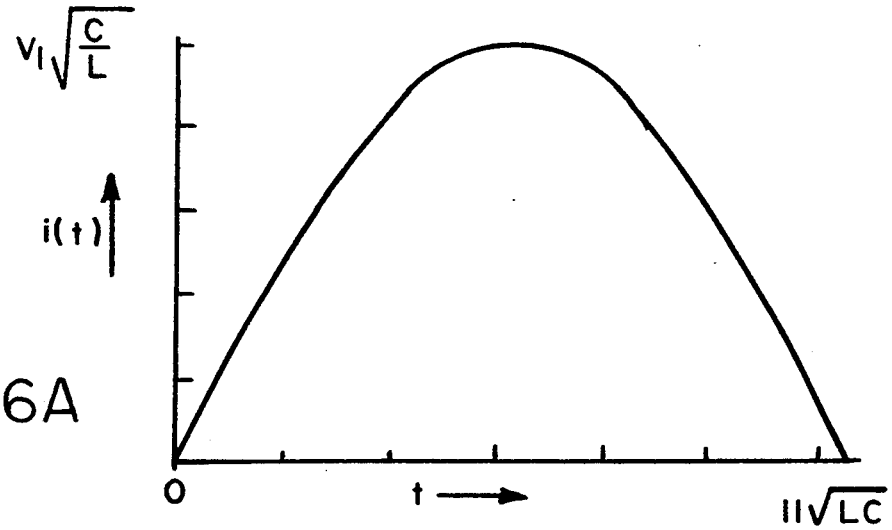
FIGS. 6A–6C are amplitude-versus-time plots of current $i(t)=i$, voltage $v(t)=v$, and energy $w(t)=w$ of the circuit of FIG. 5 if the switch SC1 is closed at the time $t=0$.
Figure 6B:
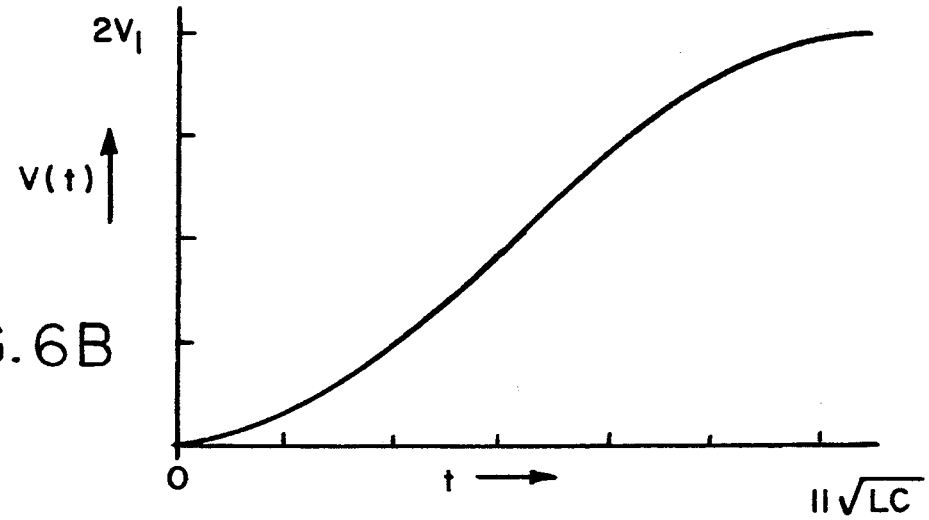
Figure 6C:
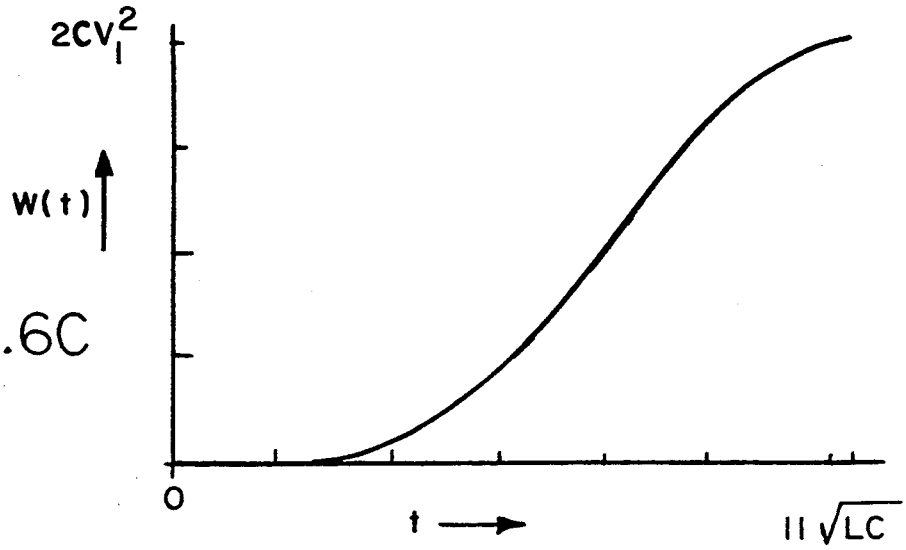

Plots of i(t), v(t) and w(t) are shown in FIG. 6. At the time $t = \pi\sqrt{LC}$ the current i(t) is zero and the switch SC in FIG. 5 or the switches SC1 and SC2 in FIG. 4 can be opened. Voltage and energy at $t = \pi\sqrt{LC}$ become:

$$v(\pi\sqrt{LC}) = 2V_1 \quad (4)$$

$$w(\pi\sqrt{LC}) = 2CV_1^2 \quad (5)$$

If the radiator is designed to radiate the energy $2CV_1^2$ every time the switches S1, S4 or S3, S2 in FIG. 4 are closed, there will be no energy left that has to be dissipated in the switches. This is, of course, idealized. But it is important that the practical limitations come now from the less-than-ideal behavior of the circuit components rather than the circuit design as in FIG. 1.

We still must overcome a second problem. According to FIG. 3 we need currents with constant amplitude −I in the interval $t_1 \leqq t \leqq t_2$ or +I in the interval $t_4 \leqq t \leqq t_5$. Such constant currents are provided in FIG. 4 by the diode DC1, the resistor R1, and the voltage $V_0$ or by DC2, R2, $V_0$ in the right half of the circuit. Let $V_0$ be about 0.5 V. As the capacitor C1 is discharged by the closing of S1 and S4, the voltage $v_{cl}$ will drop below $V_0$ and a constant current will flow from $V_0$ through R1, DC1, S1 and S4. The voltage $V_0$ has to be about 0.5 V since the diode requires that much to conduct. The resistor R1 permits a fine adjustment of the current. The operation of the circuit depends on the ability to make $V_0$ much smaller than $V_1$. We have pointed out that $V_1$ must be about 10 V for transistors in MOS technology, but much larger values are possible with light activated semiconductor switches or pulsatrons.

Figure 7:
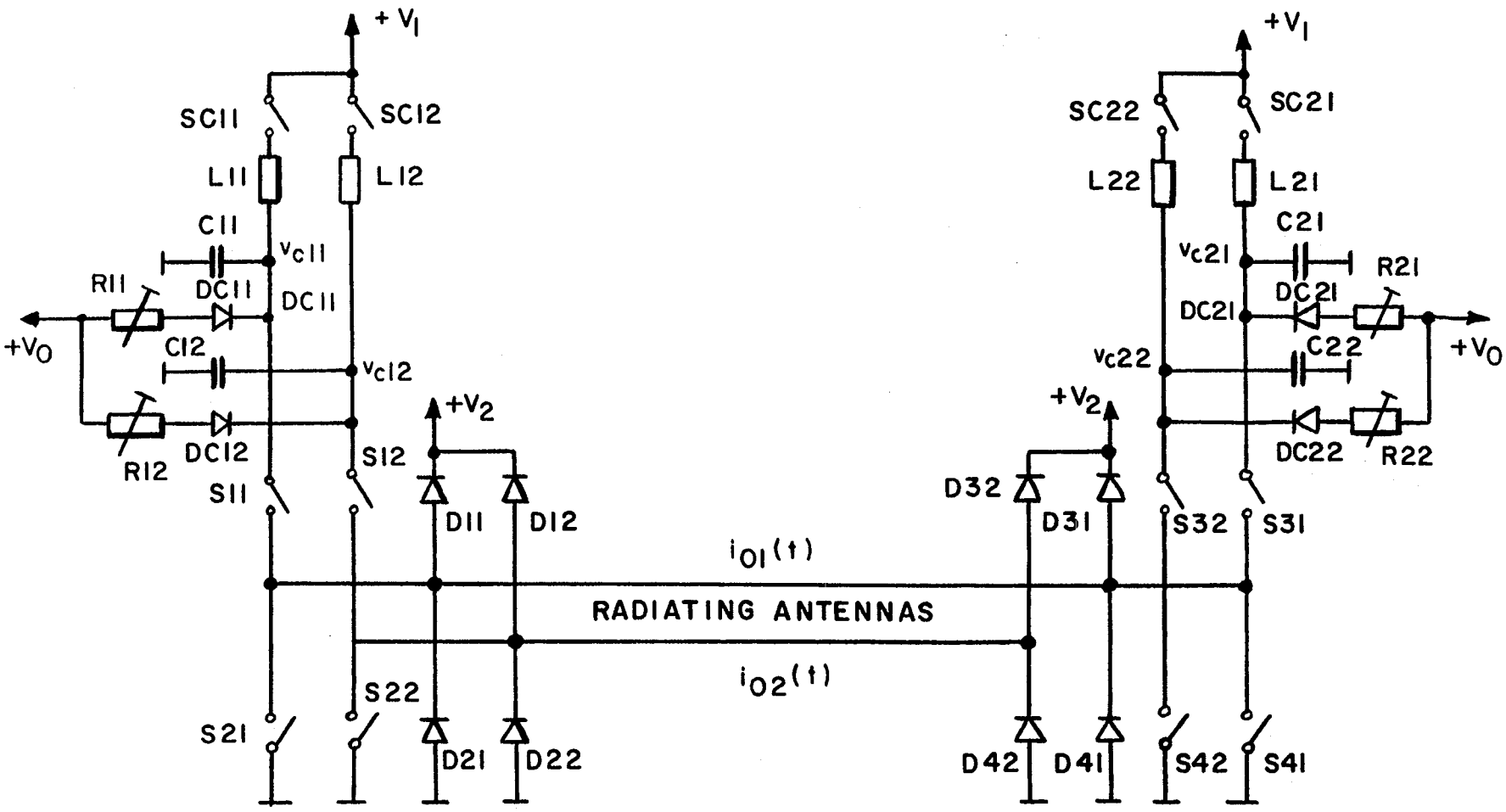
FIG. 7 is a schematic circuit drawing showing a second embodiment of the invention, wherein a charge to the circuit of FIG. 4 permits radiation of certain sequences of positive and negative pulses.
Figure 8:
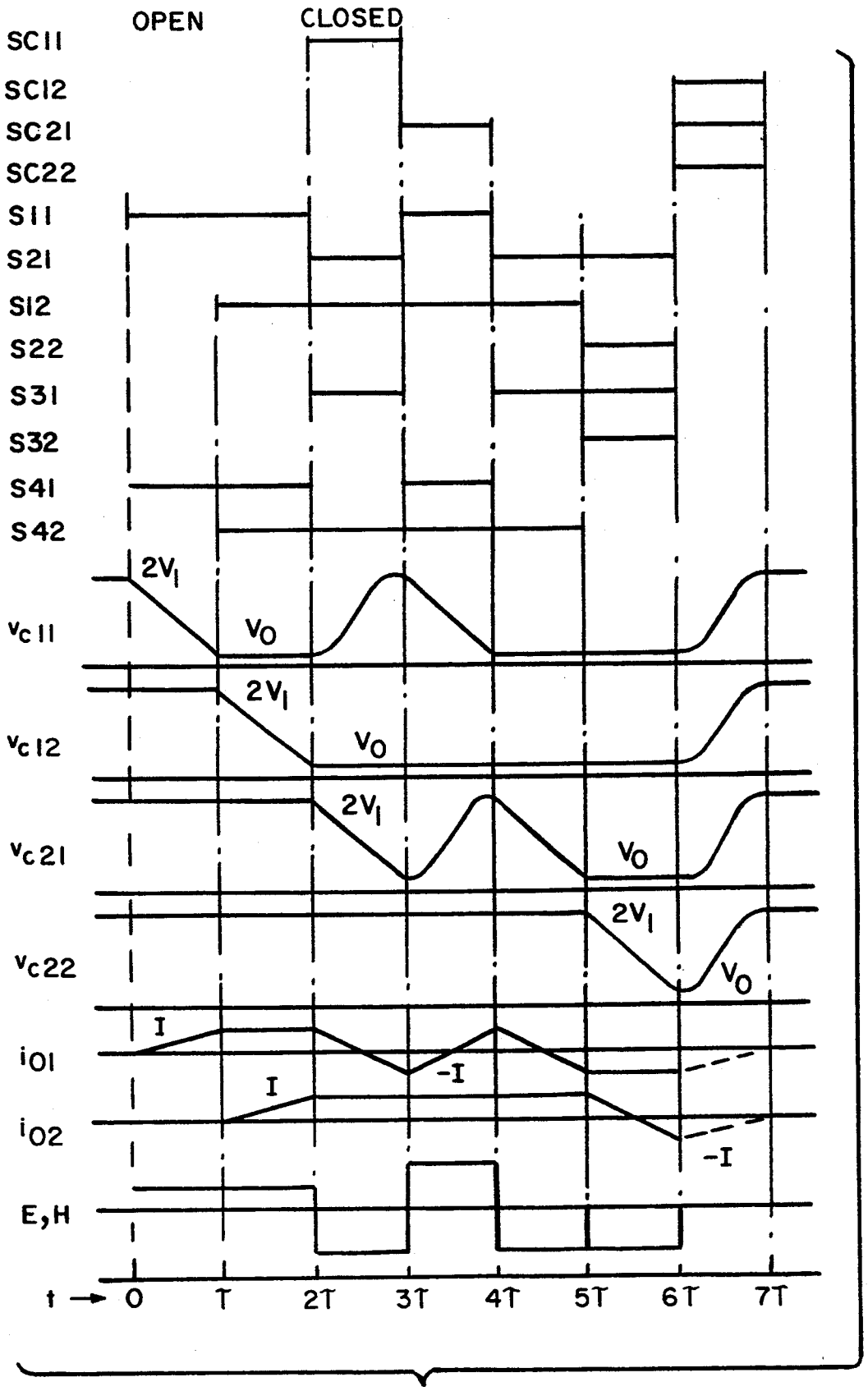
FIG. 8 is a depiction of a time sequence showing the opening and closing of the switches of the circuit of FIG. 7 as well as voltages and currents therein, and the time variation of electric and magnetic field strengths E and H produced in the far field; the unit of the time scale is $\tau=\pi\sqrt{LC}$.

Consider the circuit of FIG. 7, which consists in essence of two circuits according to FIG. 4. A time diagram is shown in FIG. 8. Let the capacitors C11, C12, C21 and C22 be fully charged up at t=0. The switches S11 and S41 are closed at the time t=0. The voltage $v_{c11}$ decreases from $2V_1$ to $V_0$; the linear decrease shown for $v_{c11}$ in FIG. 8 is, of course, idealized. The current $i_{01}$ increases from 0 to I in the interval $0 \leqq t \leqq \tau$ and is held constant via diode DC11 in the interval $\tau \leqq t \leqq 2\tau$. At $t = \tau$ the switches S12 and S42 are closed. The voltage $v_{c12}$ drops from $2V_1$ to $V_0$ during the interval $\tau \leqq t \leqq 2\tau$; the current $i_{02}$ rises from 0 to I. During the next interval $2\tau \leqq t \leqq 3\tau$ the switch SC11 is closed and capacitor C11 is recharged. At the same time the closing of the switches S21 and S31 makes the voltage $v_{c21}$ drop from $2V_1$ to $V_0$ while current $i_{01}$ drops from +I to −I. The operation of the circuit of FIG. 7 in the interval $3\tau \leqq t \leqq 7\tau$ should be understandable from this description.

The currents $i_{01}$ and $i_{02}$ of FIG. 8 flow in the radiating antennas of FIG. 7. The electric and magnetic field strengths produced in the far field vary like the sum of the derivatives of the currents as shown in the last line denoted E, H of FIG. 8. A sequence of binary pulses has been produced, which is the type of signal wanted for radio or radar transmission.

There are still three improvements one would want to make in the circuit of FIG. 7:

1) the two radiating antennas should be combined into one;
2) the first two pulses of E, H in FIG. 8 have only half the amplitude of the other pulses; and
3) no more than two successive pulses E, H can have the same polarity.

Figure 9:
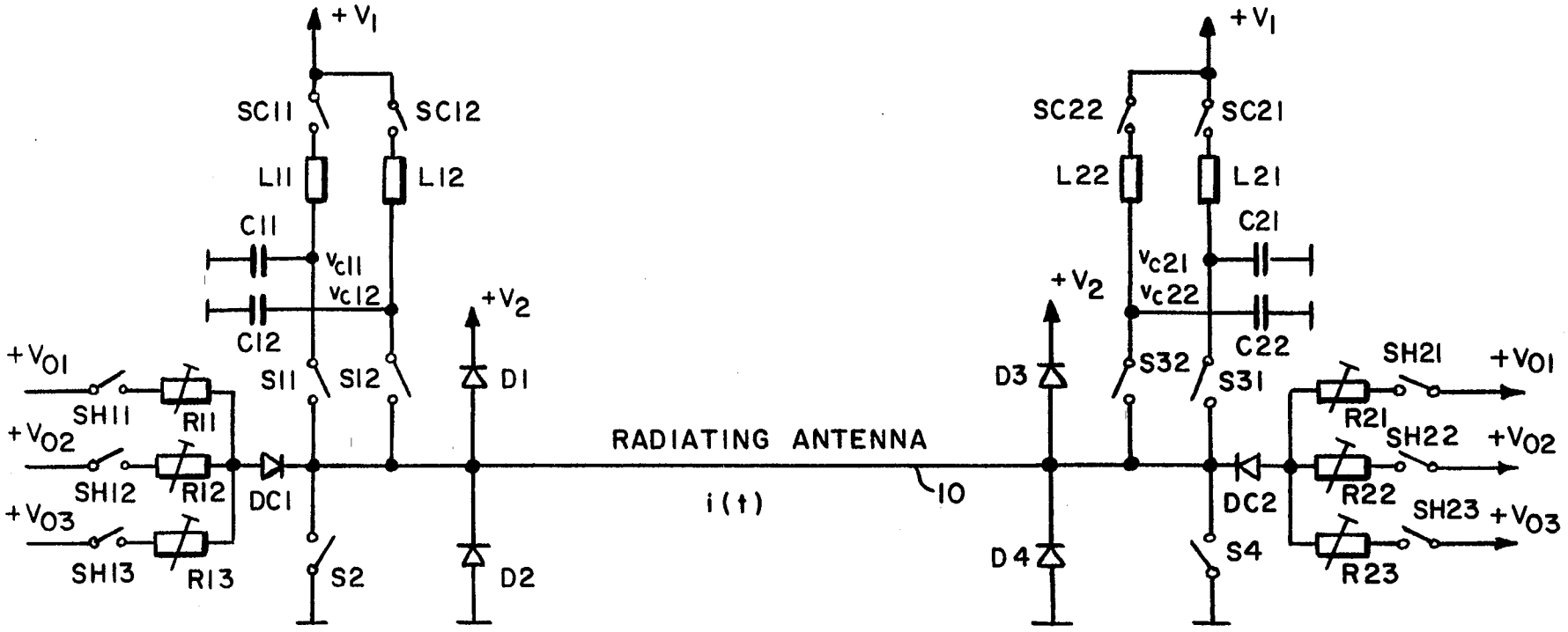
FIG. 9 is a schematic circuit diagram showing yet another variation on the circuit of FIG. 7 that permits radiation of a greater variety of sequences of positive and negative pulses.

These three problems are overcome by the circuit of FIG. 9. Its time diagram is shown in FIG. 10.

The main difference between the circuits of FIG. 7 and FIG. 9 is that the two radiating antennas are replaced by one. Furthermore, the constant current supplied by the diodes DC11, DC12, DC21, DC22 via the switches S11, S12, S31, S32 to the radiating antennas in FIG. 7 is supplied directly in FIG. 9 by the diodes DC1 and DC2. This new arrangement calls for the additional switches SH11 to SH23.

Figure 10:
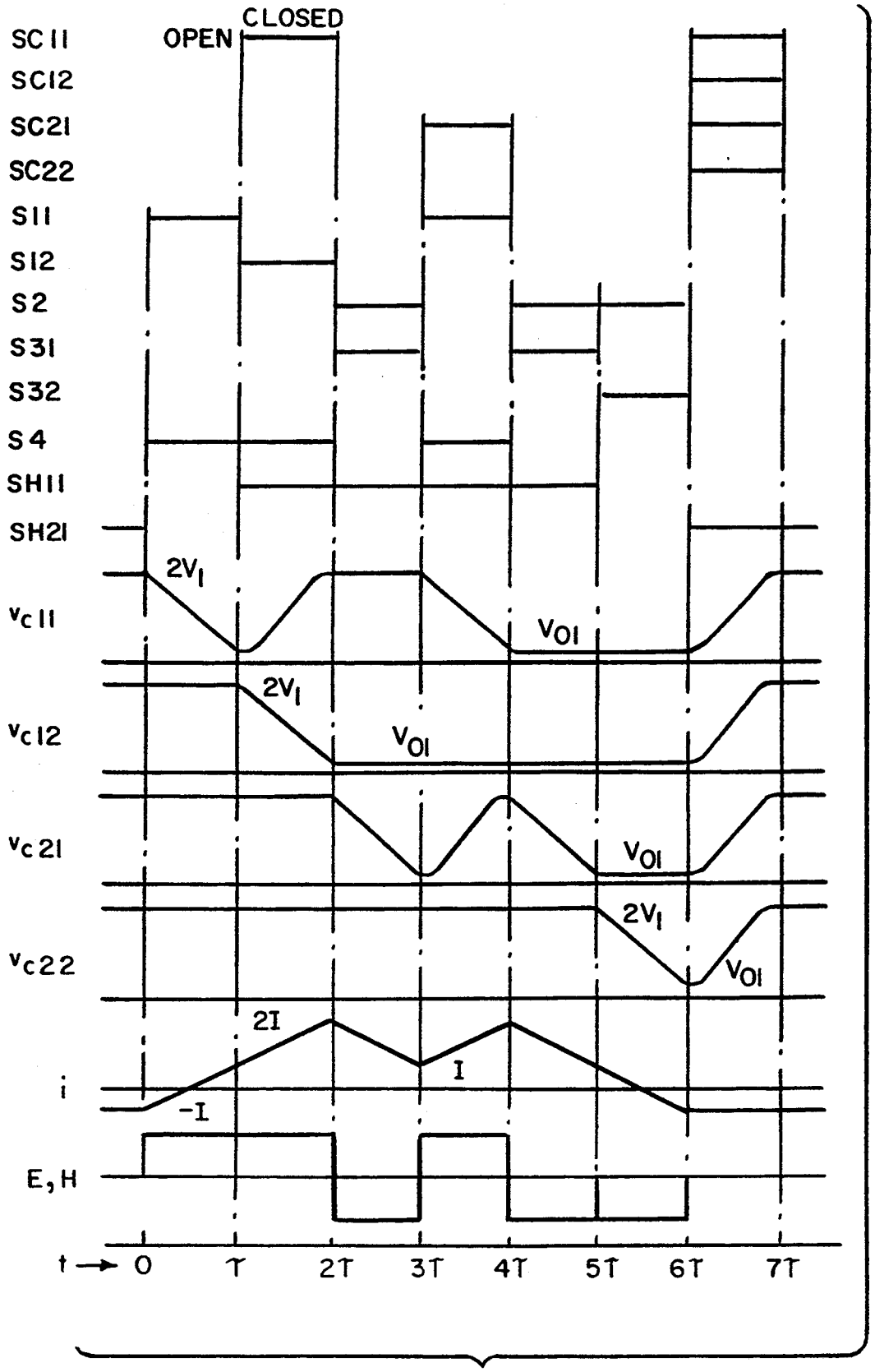
FIG. 10 is a depiction of a time sequence showing the operation of the switches of the circuit of FIG. 9 as well as voltages and currents therein, and the time variation of the field strengths E and H in the far zone; the unit of the time scale is $\tau=\pi\sqrt{LC}$.

Consider the time diagram of FIG. 10. The capacitors C11, C12, C21, C22 are assumed to be charged up at the time $t=0$. The closing of the switches S11 and S4 at $t=0$ discharges C11 and the voltage $v_{c11}$ drops to the voltage $V_{01}$ supplied via the closed switch SH11 and the diode DC1. During the time interval $\tau \leqq t \leqq 2\tau$ the capacitor C11 is recharged via the closed switch SC11; the capacitor C12 is discharged via the closed switches S12 and S4. The discharge current is added to the constant current supplied by switch SH11 via the diode DC1. This summing of two currents is possible because the radiating antenna as well as switch S4 present a negligible ohmic resistance to the constant current from diode DC1. Hence, the current produces no voltage drop across the radiating antenna or switch S4 that would produce an effect on the discharge current coming from capacitor C12 via the switch S12.

This short description of the operations in the time interval $0 \leqq t \leqq 2\tau$ should suffice to make understandable the operations in the time interval $2\tau \leqq t \leqq 7\tau$ in FIG. 10. The current i shown there is produced in the radiating antenna and the time variation E, H is obtained for the electric and magnetic field strength in the far field. A comparison with the plot E, H in FIG. 8 shows that the amplitude of the first two pulses has been doubled.

Only the voltages $V_{01}$ and the switches SH11, SH21 are used in the time diagram of FIG. 10. This is because the longest sequence of pulses with equal polarity is two in the plot E, H of FIG. 10. All three voltages $V_{01}$, $V_{02}$, $V_{03}$ and the switches SH11, SH12, SH13 would have to be used if the longest sequence of positive pulses were four pulses; similarly, all the switches SH21, SH22, SH23 would be used if the longest sequence of negative pulses were four pulses.

Having thus described the basic concept of the invention, it will be readily apparent to those skilled in the art that the foregoing detailed disclosure is intended to be presented by way of example only, and is not limiting. Various alterations, improvements, and modifications will occur and are intended to those skilled in the art, though not expressly stated herein. These modifications, alterations, and improvements are intended to be suggested hereby, and are within the spirit and scope of the invention. Accordingly, the invention is limited only by the following claims and equivalents thereto.

What is claimed is:

1. In a circuit for driving a large-current radiator, the circuit being of a type having at least a first switching circuit, coupled to the radiator, for switching a current pulse through the radiator over a short time, the improvement comprising:

a) a means for feeding a stored limited energy to said switching circuit, said means for feeding including a means for storing the limited energy; and b) a means for providing a constant current through the radiator, without creating a large voltage across said switching circuit, thereby avoiding the dissipation of a substantial part of the stored limited energy in the switching circuit.

2. A driver circuit, as recited in claim 1, wherein the means for storing limited energy includes at least one capacitor.

3. A driver circuit, as recited in claim 2, wherein the means for storing limited energy includes a means for choosing the amount of energy to be just large enough to be dissipated in the radiator, and leaving essentially no energy to be dissipated in the driver circuit.

4. A circuit for driving a large current radiator, the circuit having first and second switching circuits, coupled to the radiator, for switching a current pulse through the radiator to permit the radiation of a sequence of continguous pulses of the same polarity, comprising:

a) a first and second means for feeding to each of said first and second switching circuits, respectively, in an alternating sequence, stored limited energy, said first and second means for feeding respectively including a first and second means for storing limited energy; and b) first and second means for providing a constant current through the radiator, without creating a large voltage across the respective switching circuits, thereby avoiding the dissipation of a substantial part of the stored limited energy in the first and second switching circuits.

5. A driver circuit, as recited in claim 4, wherein the first and second means for storing limited energy include at least one capacitor, and a means for discharging said at least one capacitor of one means for storing while recharging said at least one capacitor of the other means for storing.

6. A driver circuit, as recited in claim 5, wherein the first and second means for storing limited energy include a means for choosing the amount of energy to be just large enough to be dissipated in the radiator, and leaving essentially no energy to be dissipated in the driver circuit.

7. A method for driving a large-current radiator circuit, the circuit having at least a first switching circuit coupled to the radiator, comprising the steps of:

drawing a limited energy value from a power supply;

storing the limited energy value in a storage capacitor;

feeding the stored limited energy to the large-current radiator; and providing a constant current through the radiator, without creating a large voltage across the switching circuit, in response to an opening of the switching circuit.

8. The method of claim 7, further comprising the step of choosing the stored limited energy to be substantially the same as the amount the large-current radiator is designed to radiate.

9. A method for driving a large-current radiator having first and second switching circuits, coupled to the radiator, comprising the steps of:

feeding to each of the first and second switching circuits, respectively, in an alternating sequence, stored limited energy; and providing a constant current through the radiator, without creating a large voltage across either one of the first and second switching circuits, in response to an opening of either one of the first and second switching circuit.

10. The method of claim 9, further comprising the step of choosing the stored limited energy to be substantially the same as the amount the large-current radiator is designed to radiate.

* * * * *